US006926268B2

(12) United States Patent
Jeong et al.

(10) Patent No.: US 6,926,268 B2
(45) Date of Patent: Aug. 9, 2005

(54) PAPER CASSETTE

(75) Inventors: Heung-sup Jeong, Suwon (KR); Jin-Soo Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 26 days.

(21) Appl. No.: 10/454,596

(22) Filed: Jun. 5, 2003

(65) Prior Publication Data

US 2004/0051233 A1 Mar. 18, 2004

(30) Foreign Application Priority Data

Sep. 13, 2002 (KR) ..... 10-2002-0055815

(51) Int. Cl.[7] ..... B65H 3/54
(52) U.S. Cl. ..... 271/170
(58) Field of Search ..... 271/170

(56) References Cited

FOREIGN PATENT DOCUMENTS

JP 6 - 263262 * 9/1994 ..... B65H/1/12

JP 2001 - 88970 * 4/2001 ..... B65H/3/54

* cited by examiner

*Primary Examiner*—Donald P. Walsh
*Assistant Examiner*—Kenneth W. Bower
(74) *Attorney, Agent, or Firm*—Staas & Halsey LLP

(57) ABSTRACT

A paper cassette removably connectible to a body of an image forming apparatus. The paper cassette prevents a paper from being bent or crumpled. The paper cassette has a case wherein a paper is loaded, a finger rotatably installed at a side of the case to press a front corner of the paper, a spring installed at a lower side of the finger to flexibly support the finger to press the front corner of the paper, and a pressing plate installed at a lower side of the case to press the front corner of the paper towards the finger. The finger rotates downwardly by pressing the spring when the paper is loaded. When the loading of the paper is finished, the finger is returned to a position to press the front corner of the paper by a recovery force of the spring.

18 Claims, 7 Drawing Sheets

PAPER CASSETTE

CROSS-REFERENCE TO RELATED APPLICATIONS

This application claims the benefit of Korean Application No. 2002-55815, filed Sep. 13, 2002, in the Korean Intellectual Property Office, the disclosure of which is incorporated herein by reference.

BACKGROUND OF THE INVENTION

1. Field of the Invention

The present invention relates to a paper cassette used in an image forming apparatus such as a printer, and more particularly, to a paper cassette removably mounted in a body of an image forming apparatus in which papers loaded therein are separated by a finger.

2. Description of the Related Art

An image forming apparatus such as a printer generally needs to feed papers with an appropriate size to print a wanted image. To feed the papers, papers of appropriate size are loaded in a paper cassette, and the paper cassette having the loaded paper is mounted in the printer.

FIG. 1 shows one example of the above paper cassette. Referring to FIG. 1, the paper cassette 10 includes a case 12, fingers 14 and a pressing plate 16. The case 12 has a rectangular shape and is formed to be appropriate to loaded papers.

The fingers 14 are provided at both front corners of the case 12 so that the fingers 14 can press on both front corners of a paper. The fingers 14 are formed in the manner that the paper is separated one by one by a pick-up roller (not shown) placed at the upper side of the paper cassette 10 when the paper cassette 10 is mounted in a body of the image forming apparatus (not shown).

The pressing plate 16 is installed at the base plane of the case 12 and presses loaded papers against the fingers 14. A spring 18 to press the pressing plate 16 towards the fingers 14 is provided under the pressing plate 16.

When papers are loaded at the above paper cassette 10, both front corners of the papers press the fingers 14 with regular force by the pressing plate 16. When the paper cassette 10 having papers loaded therein is mounted in the image forming apparatus, the papers are separated one by one by the pick-up roller and the fingers 14.

However, when papers 1 are loaded in the above paper cassette 10, both front corners 1*a* of the papers 1 are caught by the fingers 14 as shown in FIG. 2. In this case, the front corners 1*a* of the papers 1, which are caught by the fingers 14, are bent or crumpled. When the front corners 1*a* of the papers 1 are crumpled, the papers 1 might be caught or become crooked in movement to cause a jam of the papers 1.

SUMMARY OF THE INVENTION

The present invention has been made to overcome the above-mentioned problem of the prior art. Accordingly, it is an object of the present invention to provide a paper cassette that prevents both front corners of a paper from being bent or crumpled by providing an environment for the paper not to be intervened by fingers when the paper is loaded.

Additional aspects and advantages of the invention will be set forth in part in the description which follows and, in part, will be obvious from the description, or may be learned by practice of the invention.

The foregoing and/or other aspects of the present invention are achieved by providing a paper cassette removably connectable to a body of an image forming apparatus including: a case wherein paper is loaded; a finger rotatably installed at a side of the case to press front corners of the paper; a spring installed at a lower side of the finger to flexibly support the finger to press a front corner of the paper; and a pressing plate installed at a lower side of the case to press the front corner of the paper towards the finger. The finger rotates downwardly, pressing the spring when the paper is loaded, and when the loading of the paper is finished, the finger is returned to a position to press the front corners of the paper by the recovery force of the spring.

In an aspect of the invention, the finger and the spring each are plural in number so as to be installed at both sides of the case in order to press the front corners of the paper. In another aspect of the invention, the spring is a torsion spring.

In yet another aspect of the invention, the paper cassette includes a finger stopping portion installed at a front side of the case to limit a range of an upward rotation of the finger.

The foregoing and/or other aspects of the present invention may also be achieved by providing a paper cassette removably connectible to a body of an image forming apparatus including: a case wherein paper is loaded; paper holders installed inside of the case to be adjustable in accordance with the size of the paper; a finger rotatably installed at a front end of the paper holders to press front corners of the paper; a spring installed at a lower side of the finger to flexibly support the finger to press a front corner of the paper; and a pressing plate installed at a lower side of the case to press the front corner of the paper towards the finger. The finger rotates downwardly pressing the spring when the paper is loaded, and when the loading of the paper is finished, the finger is returned to a position to press the front corners of the paper by the recovery force of the spring.

In an aspect of the invention, the paper holder is plural in number so as to be installed at both sides of the paper within the case. In yet another aspect of the invention, the paper cassette further comprises finger stopping portions installed at front ends of the paper holders to limit a range of an upward rotation of the fingers.

According to the paper cassette of the present invention, a paper can be prevented from being bent or crumpled as fingers are bent downwardly when the paper is loaded. Therefore, a paper jam generated because the paper is bent or crumpled is also prevented.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
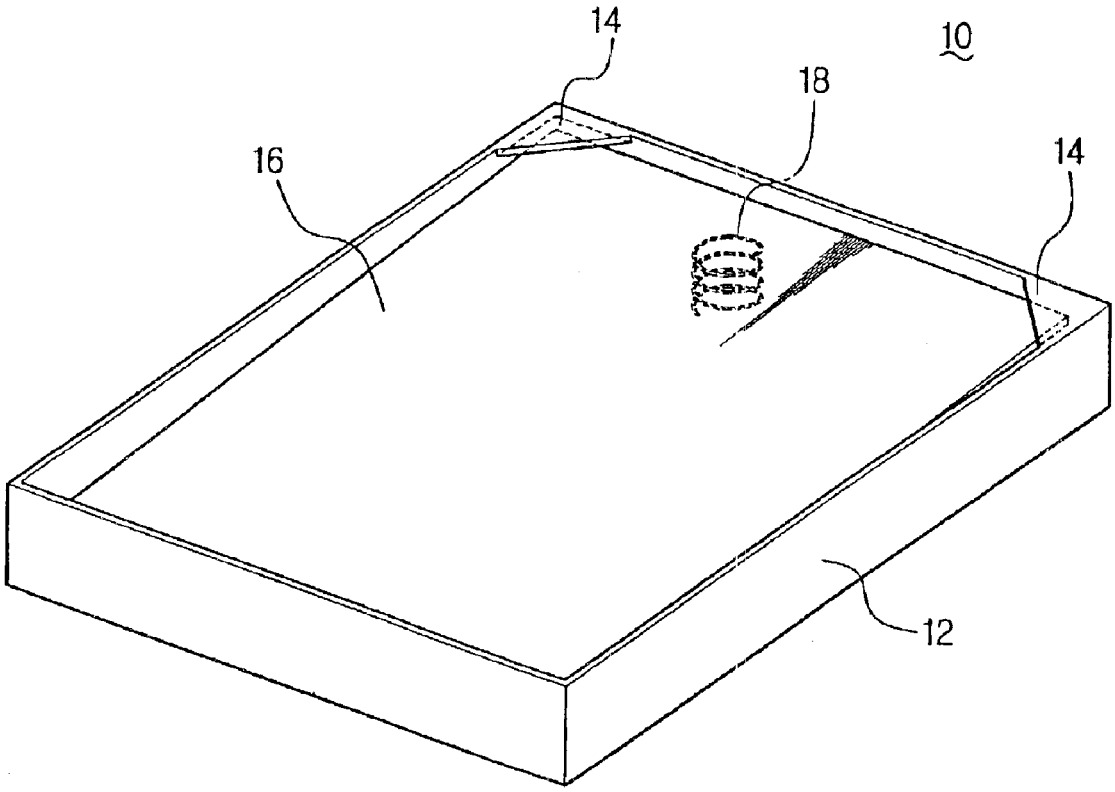
FIG. 1 (PRIOR ART)
FIG. 1 is a perspective view showing one example of a conventional paper cassette.
Figure 2:
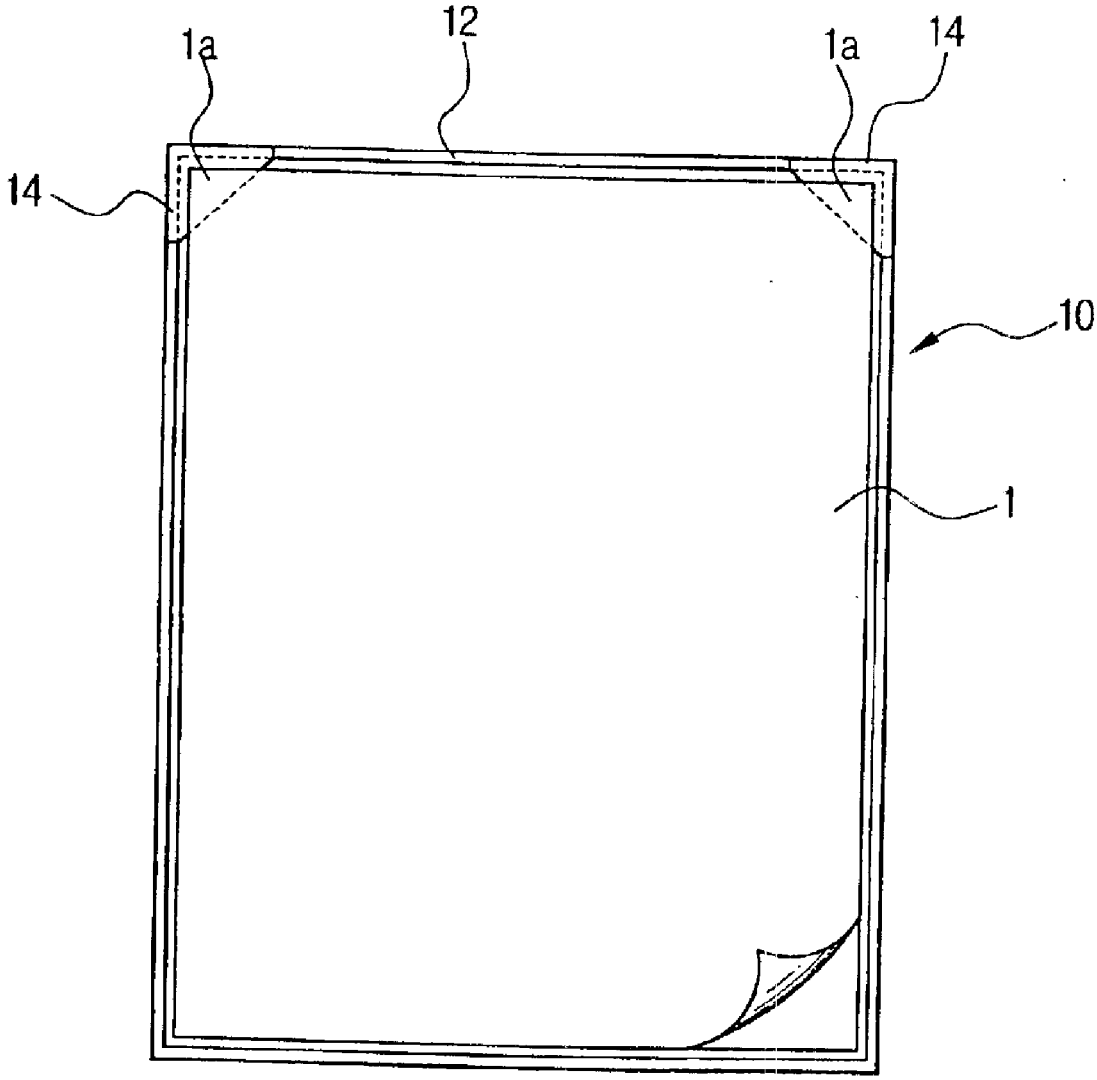
FIG.2 (PRIOR ART)
FIG. 2 is a view showing a paper having its corners caught by fingers when the paper is loaded at the paper cassette of FIG. 1.

Reference will now made in detail to the embodiments of the present invention, examples of which are illustrated in the accompanying drawings, wherein like reference numerals refer to the like elements throughout. The embodiments are described below in order to explain the present invention by referring to the figures.

Figure 3:
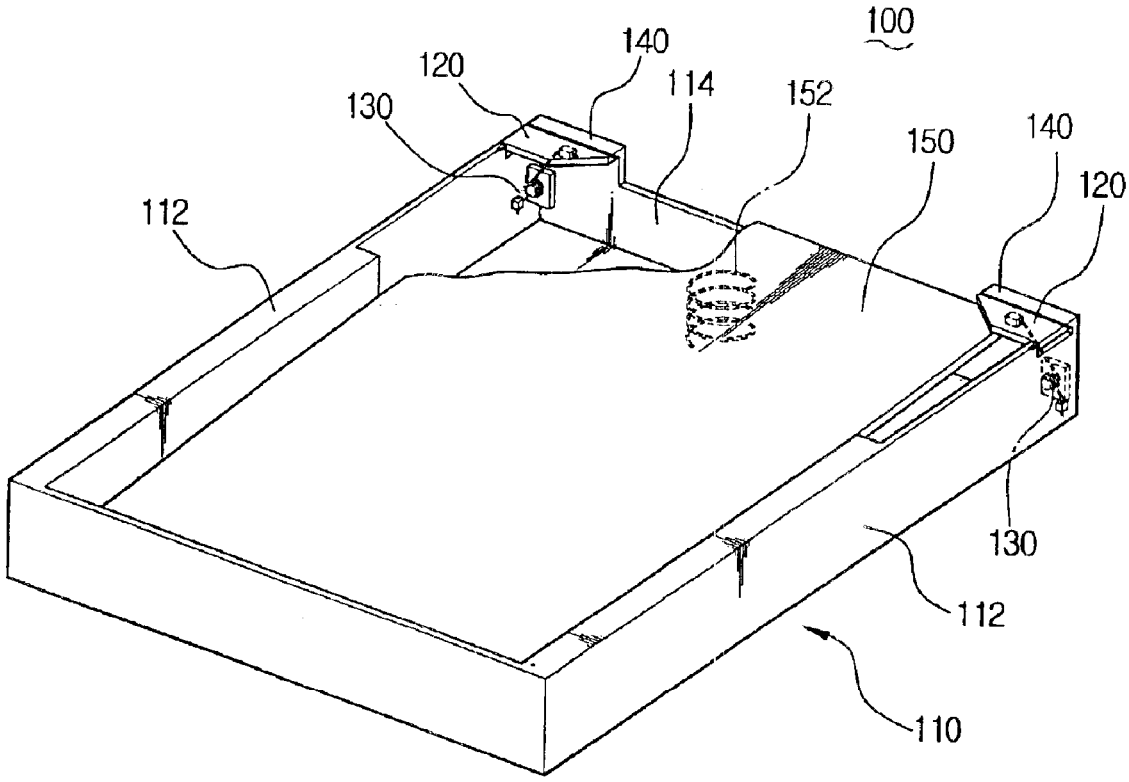
FIG. 3 is a perspective view showing an embodiment of a paper cassette according to the present invention.

FIG. 3 shows a paper cassette according to an embodiment of the present invention.

Referring to FIGS. 3 to 7, the paper cassette 100 of this embodiment includes a case 110, fingers 120, springs 130, finger stopping portions 140, and a pressing plate 150.

The case 110 has a rectangular shape, and is formed in a size corresponding to the size of a paper. The case 110 enables the paper cassette 100 to be loaded with the papers and separably mounted in an image forming apparatus body (not shown).

Figure 4:
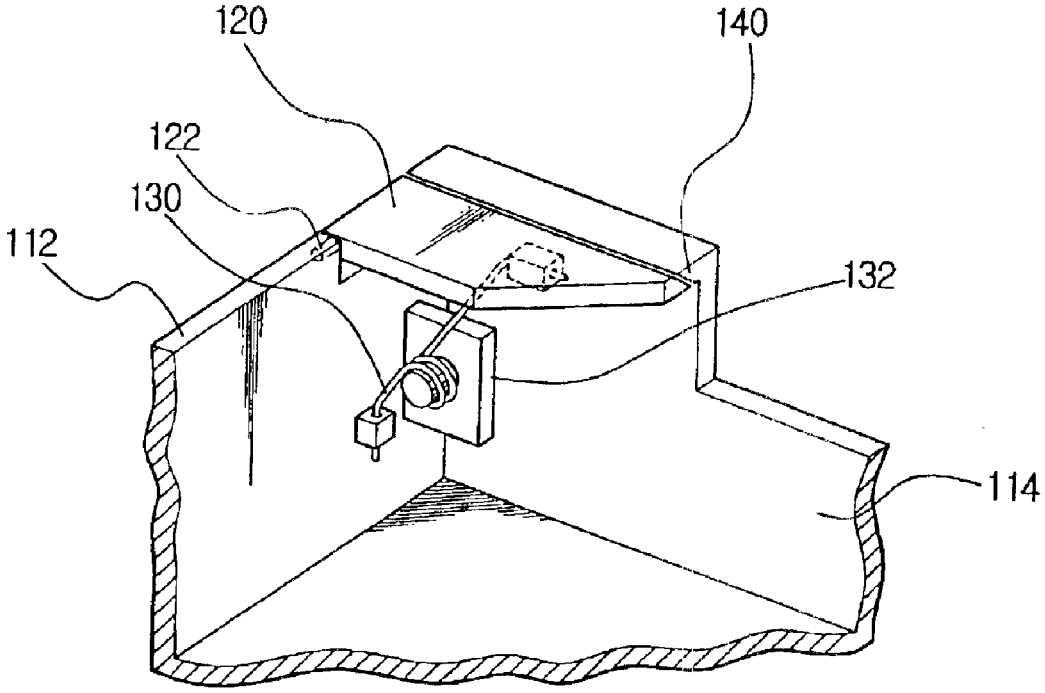
FIG. 4 is a partial perspective view showing the adjacent part of the fingers of FIG. 3.
Figure 5:
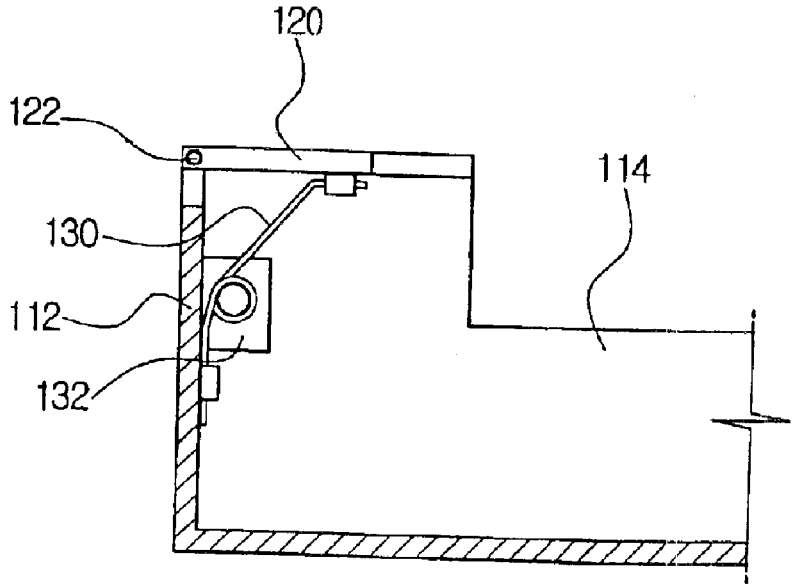
FIG. 5 is a partial front section view showing the adjacent part of the fingers of FIG. 3.

The fingers 120 are hinged at the front end of one side of the case 110 so that they can press both front corners of a paper. In other words, as shown in FIG. 4, one end of each of the fingers 120 is connected with the side 112 of the case 110 in order to rotate on a hinge portion 122. The shape of the fingers 120 is formed to allow a paper being pressed by the fingers 120 to be separated one by one by a pick-up roller 160 (refer to FIG. 8) installed at the body of the image forming apparatus.

Each of the springs 130 is installed below the fingers 120, with one end being fixed at the lower side of the fingers 120 and the other end being fixed at an inner wall of the side 112 of the case 110. The springs 130 should have enough strength to hold the paper, which is versatilely supported upwardly by the pressing plate 150, in a predetermined position, and it could be pressed downwardly when the paper is loaded. The springs 130 can be realized with any type of spring that meets the above condition such as a compression coil spring, but a torsion spring is preferred. When the torsion spring 130 is used, it is preferable that a spring supporting member 132 is installed to fix the position of the torsion spring 130.

The finger stopping portions 140 are installed at the front side 114 of the case 110 and limit the range of the upper rotation of the fingers 120. In other words, when the paper is loaded, the finger stopping portions 140 stop the fingers 120 from being bounced upwardly by the recovery force of the springs 130. Moreover, when the finger stopping portions 140 are employed, the force exerted on the fingers 120 by the pressing plate 150 can be blocked by the finger stopping portions 140. Therefore, since the springs 130 only need a recovery force to an extent to return the fingers 120, springs having lesser strength can be used.

Figure 6:
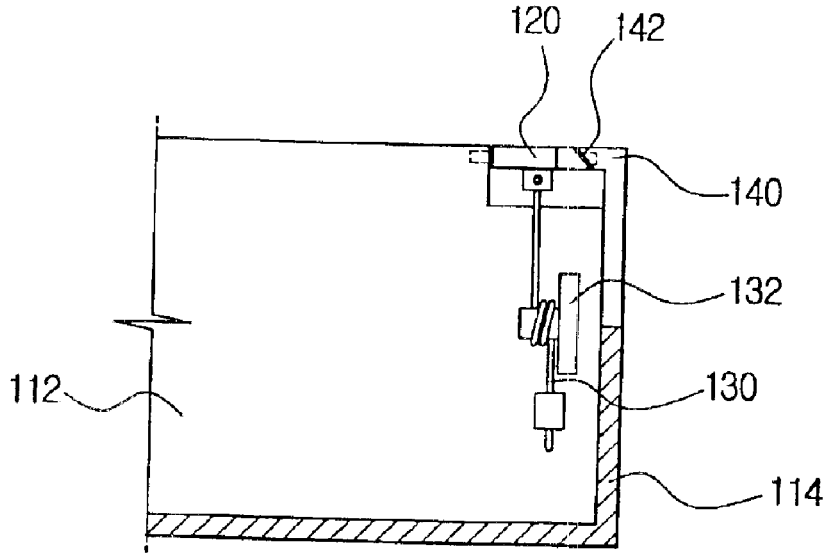
FIG. 6 is a partial side section view showing the adjacent part of the fingers of FIG. 3.

It is preferable that the contact area of the finger stopping portions 140 and the fingers 120 are formed as a sloping side 142 as shown in FIG. 6.

The fingers 120, the springs 130, and the finger stopping portions 140 described so far can be installed at one side of the case 110. However, as shown in FIG. 3, it is preferable that the above parts are installed at both sides of the case 110 so that both front corners of a paper can be pressed evenly.

The pressing plate 150 is installed at the bottom of the case 110, and presses a loaded paper upwardly. A spring 152 is installed below the pressing plate 150 so that the pressing plate 150 can be always pressed towards the fingers 120. Accordingly, the corners of the paper loaded on the pressing plate 150 are pressed by even power of the fingers 120 and the pressing plate 150.

Hereinbelow, the operation of the present embodiment of the paper cassette 100 having the above structure will be dealt with by referring to FIGS. 3 to 8.

Figure 7:
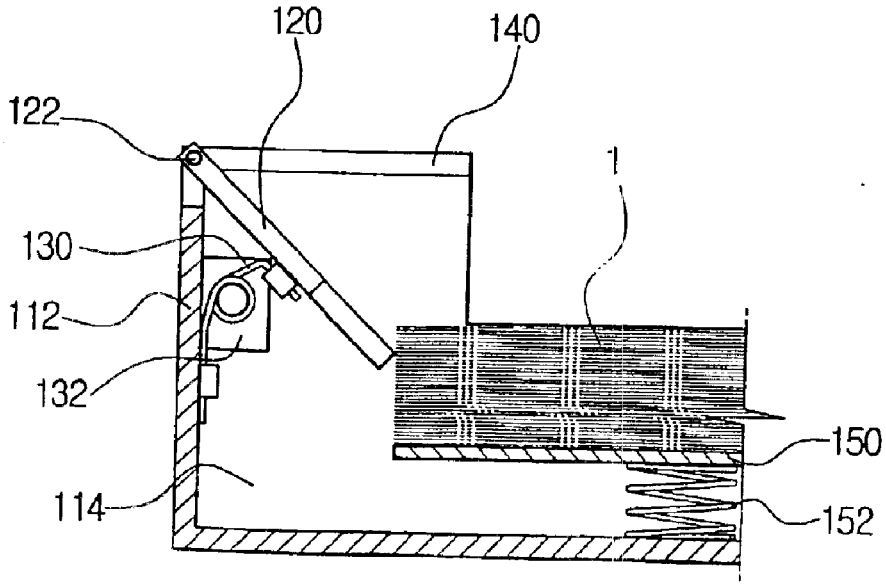
FIG. 7 is a partial front section view showing the operation of the paper cassette of FIG. 3 when a paper is loaded in the paper cassette.

As the paper 1 is loaded on the pressing plate 150, as shown in FIG. 7, the fingers 120 rotate downwardly about the hinge portion 122, pressing the springs 130 by the front corners of the paper 1. When the paper 1 is placed on the pressing plate 150, the paper 1 is pressed and the pressing plate 150 is lowered. When the pressing plate 150 is pressed downwardly, the fingers 120 are released from the intervention of the corners of the paper 1, and thus the fingers 120 return to their original position by rotating upwardly due to the recovery force of the pressed springs 130. At this time, when there are finger stopping portions 140, the fingers 120 stop at a predetermined position by being intervened by the sloping side 142 of the finger stopping portions 140.

After the fingers 120 are returned to their original position, when the force to press the pressing plate 150 is removed, the pressing plate 150 moves upwardly, and thus the front corners of the paper 1 on the pressing plate 150 press the fingers 120 upwardly. Therefore, some frictional force is generated between the fingers 120 and the front corners of the paper 1.

Figure 8:
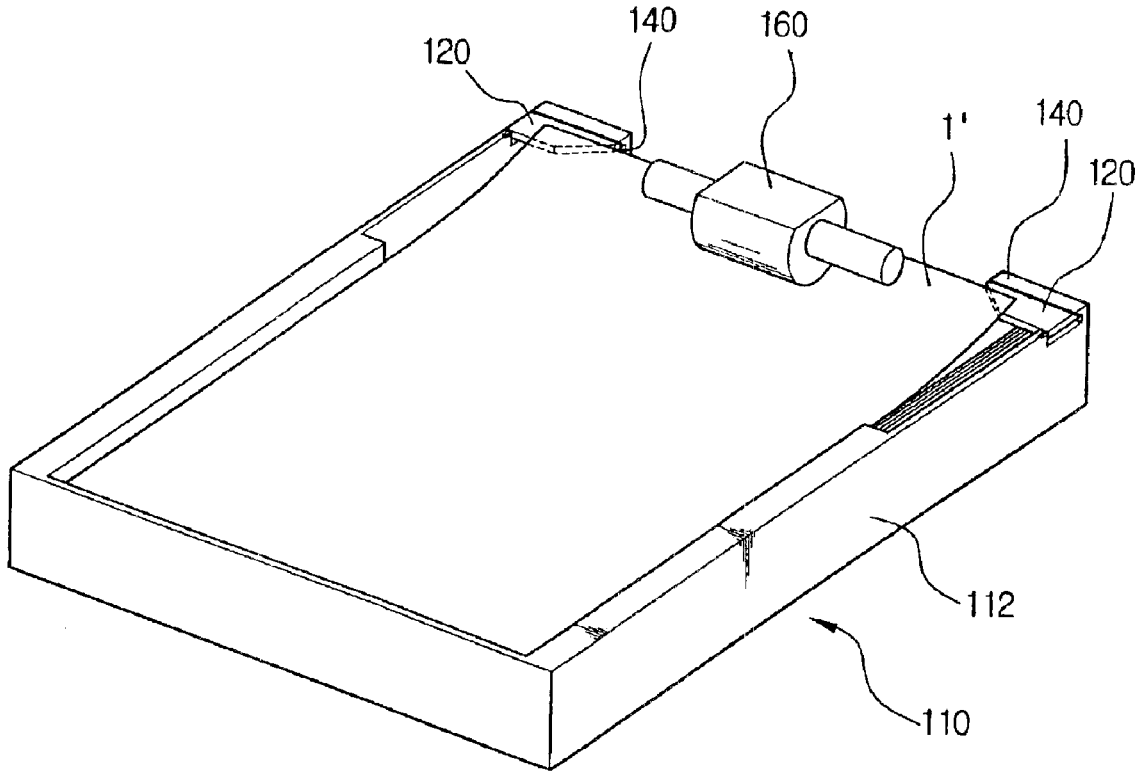
FIG. 8 is a perspective view showing the separation of the paper from the paper cassette of FIG. 3.

The paper cassette 100 having the paper 1 loaded thereon is mounted in the body of the image forming apparatus. Then, as shown in FIG. 8, the paper 1' placed on the top of the load of paper is separated by the pick-up roller 160 installed at the upper side of the paper cassette 100 and the fingers 120.

Figure 9:
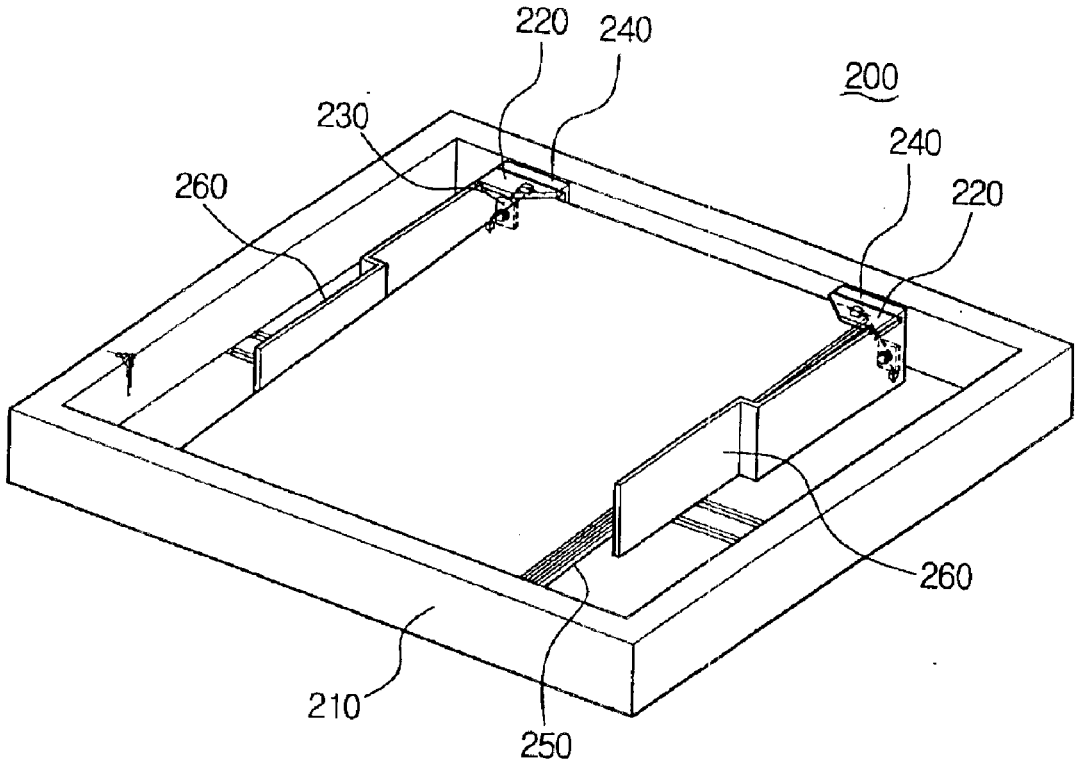
FIG. 9 is a perspective view showing another embodiment of the paper cassette according to the present invention.

FIG. 9 shows another embodiment of the paper cassette according to the present invention.

Referring to FIG. 9, the paper cassette of this embodiment includes a case 210, paper holders 260, fingers 220, springs 230, finger stopping portions 240 and a pressing plate 250.

The paper holders 260 can adjust a width in accordance with the size of the paper 1. As shown in FIG. 9, there are two paper holders 260 in order to adjust the width at both sides of the paper 1, or albeit not shown, there can be one paper holder 260. When there is one paper holder, the paper holder adjusts the width from one side of the paper 1 in accordance with the size of the paper 1 with the other side of the paper 1 being at one side of the case 210 as a reference side.

The fingers 220, the springs 230 and the finger stopping portions 240 are provided at the front end of the paper holders 260. The fingers 220 are rotatably connected with the front end of the paper holders 260 using hinges, and one end of each of the springs 230 is fixed beneath the fingers 220 and the other end is fixed at the inside wall of the paper holders 260. In addition, the finger stopping portions 240 protrude towards the front end of the paper 1 from the front end of the paper holders 260.

The structure of the case 210 and the pressing plate 250 are the same as that of the paper cassette according to the previous embodiment, and thus the description on them will be omitted here. Furthermore, the operation of the paper cassette 200 of this embodiment is almost identical to the previous embodiment except for the fact that the paper holders 260 are moved to adjust in accordance with the size of the paper 1. Thus, the rest operation of this embodiment will be omitted.

Yet, the finger, spring and finger stopping portion can be installed only at one side of the paper holders. Additionally, when there is only one paper holder, the fingers, springs and finger stopping portions can be installed at one side of the case and the paper holder.

According to the paper cassette of the embodiments of present invention, papers are not bent or crumpled because the papers are prevented from being intervened by fingers when the papers are loaded on the paper cassette. Therefore, paper jam, which is generated because the papers are caught by the fingers or crooked, is also prevented.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper cassette removably connectable to a body of an image forming apparatus, comprising;

a case wherein paper is loaded;

a finger rotatably installed at a side of the case to press front corners of the paper;

a spring installed at a lower side of the finger to flexibly support the finger to press a front corner of the paper; and a pressing plate installed at a lower side of the case to press the front corner of the paper towards the finger, wherein the finger rotates downwardly by pressing the spring when the paper is loaded, and when the loading of the paper is finished the finger returns to a position to press the front corner of the paper by a recovery force of the spring; and a finger stopping portion installed at a front side of the case to limit a range of upward rotation of the finger.

2. The paper cassette of claim 1, wherein the finger and the spring each are plural in number so as to be installed at both sides of the case to press the respective front corners of the paper.

3. The paper cassette of claim 1, wherein the spring is a torsion spring.

4. The paper cassette of claim 3, further comprising a spring supporting member positioned at a side wall of the case to fix the position of the torsion spring.

5. The paper cassette of claim 1, further comprising a finger stopping portion installed at a front side of the case to limit a range of upward rotation of the finger.

6. The paper cassette of claim 5, wherein the spring is a torsion spring.

7. The paper cassette of claim 5, wherein the finger and the finger stopping portion each has a sloping side at a portion where the finger and the finger stopping portion make contact with each other.

8. The paper cassette of claim 1, wherein one end of the spring is fixed at the lower side of the case and the other end of the spring is fixed at an inner wall of the side of the case.

9. A paper cassette removably connectible to a body of an image forming apparatus, comprising;

a case to load paper;

at least one paper holder installed in an inside of the case and adjustable in accordance with the size of the paper;

at least one finger rotatably installed at a front end of each paper holder to press front corners of the paper;

a spring installed at a lower side of the at least one finger to flexibly support the at least one finger to press the front corners of the paper; and a pressing plate installed at a lower side of the case to press the front corners of the paper towards a respective at least one finger, wherein the at least one finger rotates downwardly by pressing the spring downward when the paper is loaded, and when the loading of the paper is finished, the at least one finger returns to a position to press the respective front corner of the paper by a recovery force of the spring; and a finger stopping portion installed at a front end of the at least one paper holder to limit a range of an upward rotation of a respective at least one finger.

10. The paper cassette of claim 9, wherein the at least one paper holder is plural in number so as to have a paper holder installed at both sides of the paper within the case.

11. The paper cassette of claim 9, wherein the spring is a torsion spring.

12. The paper cassette of claim 9, further comprising a finger stopping portion installed at a front end of the at least one paper holder to limit a range of an upward rotation of a respective at least one finger.

13. The paper cassette of claim 9, wherein the spring is a torsion spring.

14. The paper cassette claim 12, wherein the finger stopping portion protrudes toward the front end of the paper from the front end of the at least one paper holder.

15. The paper cassette of claim 9, further comprising a hinge to rotatably connect the at least one finger with the front end of a respective at least one paper holder.

16. A paper cassette comprising:

a case to hold paper;

an elastic finger rotatably positioned at each front end of the case to move downward when loading the paper in the case and to bias the front edges of the paper into the case after completion of the loading of the paper; and an elastic pressing plate positioned at the bottom of the case to force paper in the case against the elastic fingers;

a spring installed at a lower side of each elastic finger; and a finger stopping portion installed at a front end of the case for each elastic finger to limit a range of upward rotation of each elastic finger.

17. A paper cassette comprising:

a case to hold paper;

a pressing plate positioned at the bottom of the case to bias the paper in the case; and a finger unit rotating in one direction away from an initial position due to the force of the paper to allow the paper to be loaded into the case, rotating in an opposite direction back to the initial position upon the paper clearing the finger unit upon being loaded into the case, and maintaining the paper in the case after the pressing plate biases the paper toward the finger unit, Wherein the finger unit comprises:

a finger;

a spring installed at a lower side of the finger; and a finger stopping portion installed at a front end of the case to limit a range of an upward rotation of the finger.

18. The paper cassette of claim 17, wherein the finger unit comprises two fingers such that a finger is positioned at each front corner of the case.

* * * * *

UNITED STATES PATENT AND TRADEMARK OFFICE

CERTIFICATE OF CORRECTION

PATENT NO. : 6,926,268 B2
APPLICATION NO. : 10/454596
DATED : August 9, 2005
INVENTOR(S) : Heung-sup Jeong et al.

It is certified that error appears in the above-identified patent and that said Letters Patent is hereby corrected as shown below:

Column 6, Line 22, after “cassette” insert --of--.

Column 6, Line 54, change “Wherein” to --wherein--.

Signed and Sealed this

Tenth Day of April, 2007

JON W. DUDAS
*Director of the United States Patent and Trademark Office*